US006695529B2

(12) United States Patent
Eslick

(10) Patent No.: US 6,695,529 B2
(45) Date of Patent: Feb. 24, 2004

(54) ROAD MATERIAL RECLAMATION DEVICE AND METHOD

(75) Inventor: Pat Eslick, Colville, WA (US)

(73) Assignee: Road Recovery Systems, LLC, Colville, WA (US)

( * ) Notice: Subject to any disclaimer, the term of this patent is extended or adjusted under 35 U.S.C. 154(b) by 0 days.

(21) Appl. No.: 09/966,820

(22) Filed: Sep. 27, 2001

(65) Prior Publication Data

US 2003/0059257 A1 Mar. 27, 2003

(51) Int. Cl.[7] ..... E01C 19/10
(52) U.S. Cl. ..... 404/91; 404/92; 404/113
(58) Field of Search ..... 404/80, 81, 75, 404/91, 92, 90, 113, 122

(56) References Cited

U.S. PATENT DOCUMENTS

| | | | | | |
|---|---|---|---|---|---|
| 287,840 | A | * | 11/1883 | Mabry | 404/92 |
| 336,164 | A | * | 2/1886 | Schillinger | 404/92 |
| 908,120 | A | * | 12/1908 | Ney | 404/92 |
| 1,369,730 | A | * | 2/1921 | Daniel | 404/92 |
| 2,030,683 | A | * | 2/1936 | Chamberlain | 404/92 |
| 2,063,400 | A | * | 12/1936 | Robb | 404/92 |
| 4,473,320 | A | * | 9/1984 | Register | 404/91 |
| 4,946,307 | A | * | 8/1990 | Jakob | 404/91 |
| 5,441,361 | A | * | 8/1995 | Campbell | 404/90 |
| 5,819,950 | A | * | 10/1998 | McCloskey | 209/241 |

* cited by examiner

*Primary Examiner*—Thomas B. Will
*Assistant Examiner*—Alexandra K. Pechhold
(74) *Attorney, Agent, or Firm*—Black Lowe & Graham PLLC

(57) ABSTRACT

A system for reclaiming displaced road surface material from along side a road. More specifically, the instant invention is a road material reclamation device including a movable fame capable of being attached to another machine. At least one cylinder drive mechanism attached to the frame and configured to rotatably support a cylindrical rotary screen. The rotary screen has an interior, a front section and a rear section, a side rolling surface located adjacent the front section and the rear section, each side rolling surface being configured to engage the drive mechanism. Located adjacent the front section is a flange section. A cylindrical end frame supports at least one cylindrical end roller, the end frame and end roller being configured to engage the flange section and prevent axial displacement of the rotary screen. Additionally, a feed chute is located adjacent the rear section and is configured to direct material into the interior adjacent the rear section.

13 Claims, 2 Drawing Sheets

ROAD MATERIAL RECLAMATION DEVICE AND METHOD

FIELD OF THE INVENTION

This invention relates generally to a moveable road material reclamation device and method of use.

BACKGROUND OF THE INVENTION

Any country's infrastructure is heavily vested in its road system. In America, as with nearly every other country, a vast amount of the roads are surfaced with crushed rock or gravel. Crushed rock is a desirable road surface material for a variety of reasons, for example, it is relatively easy to produce and provides a relatively stable road base. Although roads surfaced with crushed rock have many advantages, there are problems that arise from the use of crushed rock as a road surface material. More specifically, the crushed rock on the surface of the roadway displaces due to vehicle traffic and erosion. Eventually, the crushed rock ends up on the shoulder of the road or in the ditch, leaving the road surface bare or exposing the rough subsurface ballast. The standard solution for fixing a roadway wherein the crushed rock has displaced from the road surface currently has two solutions, either deposit new material brought in from a remote location, or attempt to recover the displaced material from along side the road and reuse it. These methods create a variety of economical, practical and legal problems.

Depositing new road material is cost prohibitive. The new material must be purchased or produced, delivered to the site and then evenly distributed over the road surface. Each step requires specific equipment and equipment operators to perform the tasks, which adds to the overall expense. Further, additional hidden costs are associated with the application of new road material, for example, wear on vehicles, liability associated with heavy vehicle use on public roads and the further destruction of the roads due to excessive vehicle weight. Consequently, the recovery of displaced road material is generally desired over bringing in new or additional road material.

Road material reclamation is generally performed by employing a machine, for example, a road grader, wherein the grader's blade is extended into the ditch to bring the displaced road material back to the top surface of the road. Subsequently, all of the material is spread evenly across the road surface. This current recovery practice is plagued by problems as well. More specifically, the blade indiscriminately brings all material that is along the side of the road onto the top surface including undesirable material such as large rocks, soil clumps and any type of debris commonly found along roads. This undesirable material creates road hazards that in turn subject the local county, state or municipality to liability for any damage resulting from the road hazard.

Yet another problem resulting from the displacement of the crushed rock road surface material is the undesirable altering of the road's profile and the resulting encroachment of the road on private lands. As road material is displaced the crown and the shoulders of the road are altered. More specifically, the surface of the road accumulates ruts and the road base widens. The ruts and other road surface anomalies caused by a loss of surface material create hazardous driving conditions and also serve to increase the rate of road degradation. The widening road base often extends the width of the road past the road's legal easement and thereby actually causing the road to "trespass" on the property of the surrounding landowners. Such a trespass likely constitutes a taking without just compensation, which the United States Constitution protects its citizens against.

SUMMARY OF THE INVENTION

The present invention comprises a system for reclaiming displaced road surface material from along side a road. More specifically, the instant invention is a road material reclamation device including a movable frame capable of being attached to another machine. At least one cylinder drive mechanism attached to the frame and configured to rotatably support a cylindrical rotary screen. The rotary screen has an interior, a front section and a rear section, a side rolling surface located adjacent the front section and the rear section, each side rolling surface being configured to engage the drive mechanism. Located adjacent the front section is a flange section. A cylindrical end frame supports at least one cylindrical end roller, the end frame and at least one end roller being configured to engage the flange section and prevent axial displacement of the rotary screen. Additionally, a feed chute is located adjacent the rear section and is configured to direct material into the interior adjacent the rear section.

In accordance with further aspects of the invention, a method of reclaiming road surface material is disclosed. The method includes depositing a conglomerate of roadside material and debris onto a top surface of a road in a windrow. The material is then transported into a reclamation device wherein the reclamation device separates the material into usable an unusable material. The usable material is deposited to form another windrow on the road surface. Conversely, the unusable material is transported a distance from the road surface. Subsequently, the usable material is leveled across the road surface.

As will be readily appreciated from the foregoing summary, the invention provides an efficient device and method for the recovery of displaced road surface material.

BRIEF DESCRIPTION OF THE DRAWINGS

The preferred and alternative embodiments of the present invention are described in detail below with reference to the following drawings.

DETAILED DESCRIPTION OF THE PREFERRED EMBODIMENT

Figure 1:
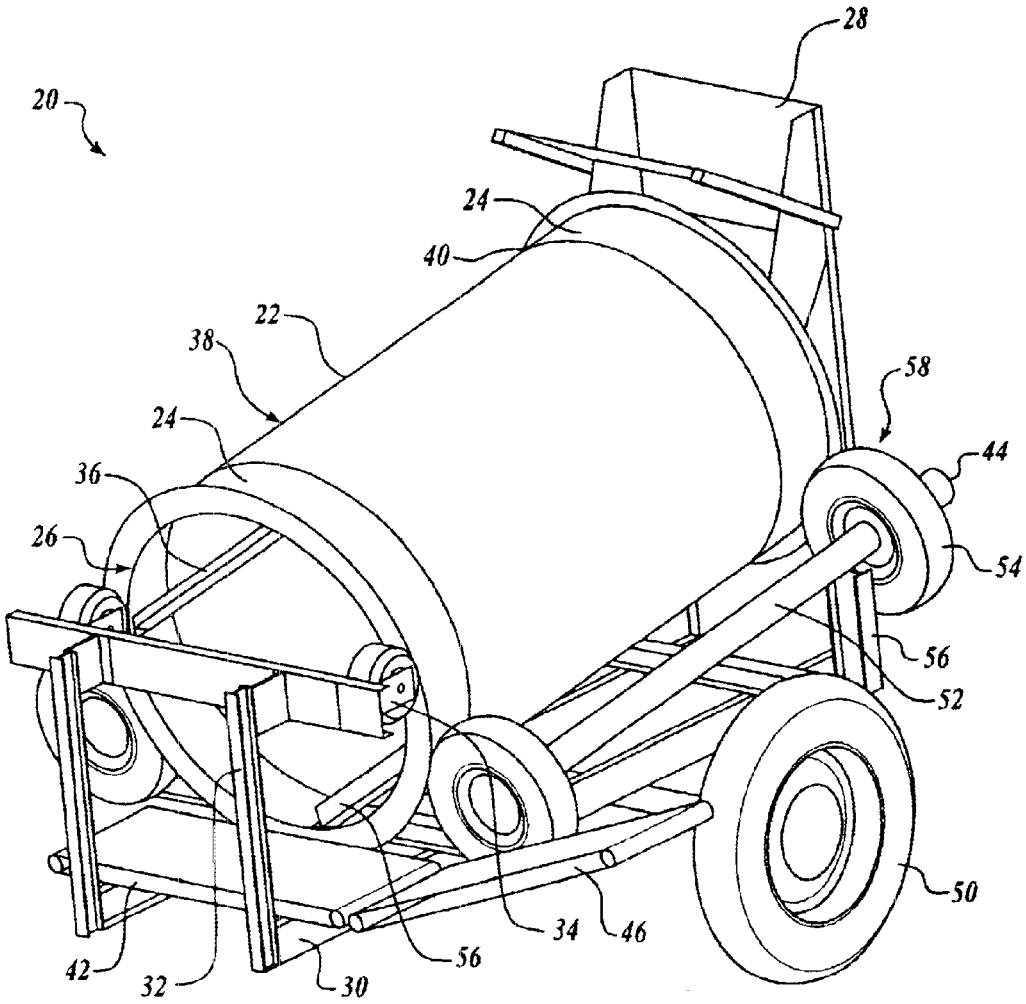
FIG. 1 is an isometric view of the invention.

Turning now to the drawings, FIG. 1 depicts a road material reclamation device 20. The reclamation device 20 includes a trailer axle 48 (FIG. 3) having a pair of trailer axle wheels 50 disposed on either end of the trailer axle 48. Supported on the trailer axle 48 is a trailer frame 30. The trailer frame 30, in turn, supports a plurality of components described in more detail below.

The particular device illustrated is employed with other material handle devices. More specifically, as the instant invention is not self-propelled. Thus, a propelling machine is preferably attached to the reclamation device 20 via a hitch (not shown) located on a front of the reclamation device 20. In a presently preferred embodiment, the instant invention is employed with an Athey belt loader (not shown). However, use of this device with any other materials handling equipment is considered within the scope of this invention, for example, a front-end loader. Likewise, employing this device in a stationary or partially stationary manner is considered within the scope of this invention.

In a presently preferred embodiment, a rotary screen 22 is substantially centrally located on the frame 30. As disclosed in the FIGS. 1–3, the rotary screen 22 is a generally cylindrically shaped screen with open ends. Located adjacent each end of the rotary screen 22 are substantially identical side rolling surfaces 24 and flange sections 26. The rolling surfaces 24 and flange sections 26 are configured to allow rolling motion between the screen 22 and the drive wheels 54 and the flange 26 and the at least one end roller 34, respectively. The rotary screen 22 is laterally supported by a cylinder drive mechanism 58, discussed in more detail below, and axially supported by a pair of cylinder end rollers 34. The drive mechanism 58 is attached to the frame by a plurality of drive axle supports 56. The supports can be configured as either fixed or variable height members, thereby allowing a variable drive mechanism and screen inclination, discussed in more detail below. The end rollers are attached to the frame 30 via a cylinder end frame 32. The end frame 32 and rollers 34 prevent excessive axial displacement of the rotary screen 22.

Figure 2:
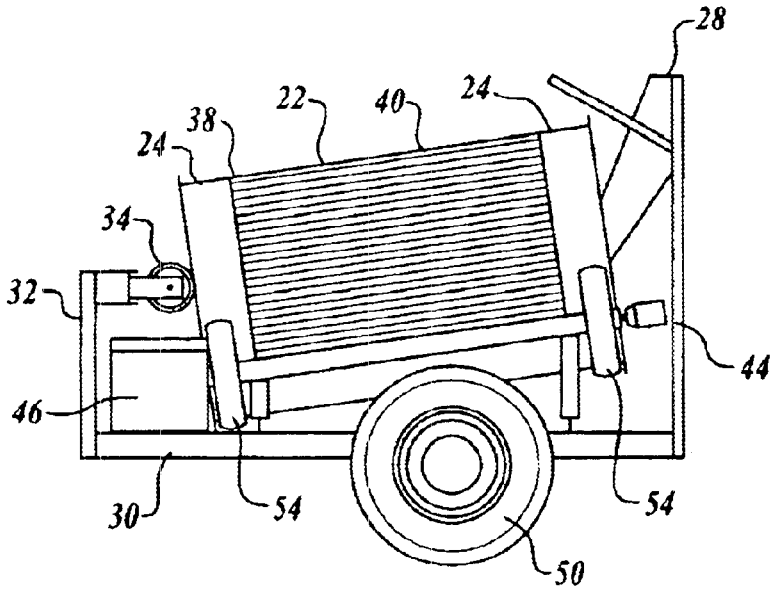
FIG. 2 is a side view of the invention.
Figure 3:
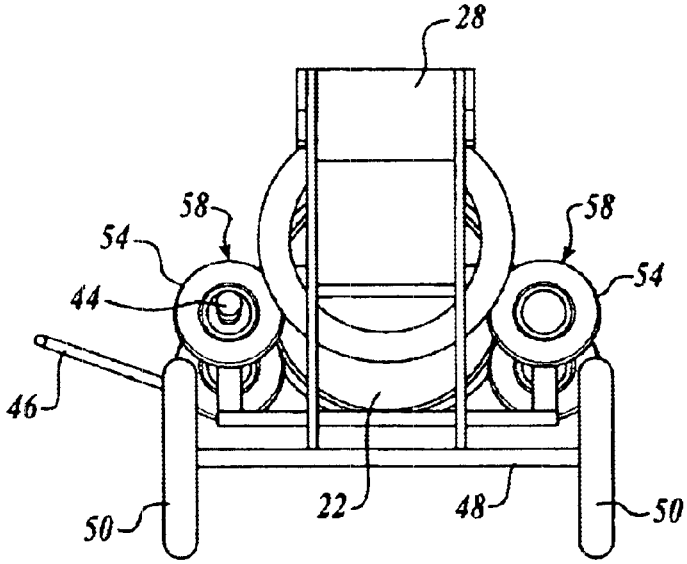
FIG. 3 is an end view of the invention.

With reference to FIGS. 1–3, the cylinder drive mechanism includes a pair of matched drive axles 52 located equidistant from a bottom center of rotary cylinder 22. Each drive axle 52 includes a pair of drive wheels 54 located at each end of the axle 52. In a presently preferred embodiment, the drive wheels 54 are pneumatic rubber tires. However, any other wheel construction is considered within the scope of this invention, for example, solid rubber tires. The drive mechanism is preferably powered by at least one hydraulic drive motor 44. However, any other power source is considered within the scope of this invention, for example, electrical or mechanical power sources. The hydraulic reservoir and control system (not shown) is either attached to the recovery device 20 (not shown) or the hydraulic motor 44 is powered remotely from the drive vehicle (not shown). The rotational speed imparted to the screen 22 is variable depending upon operating conditions.

Disposed on an inner surface of the rotary screen 22 are a plurality of agitation members 36. The agitation members 36 are axially disposed along the inner surface of the screen 22 and extend substantially the length of the screen 22. The members can also include at least one spiral member (not shown) traversing the entire length of the screen 22. The members serve to increase material separation and also increase the structural rigidity of the screen 22.

FIG. 2 more accurately depicts the screen mesh of the rotary screen 22. The size and shape of the screen mesh is variable, the selection of screen material size and shape being based upon material reclaimed material size desired. For example, a larger screen opening can be used when a relatively larger road rock is preferred for better drainage characteristics. Conversely, a smaller screen opening geometry can be employed when a smaller, more densely packed road surface is preferred.

As depicted in the FIGURES, the rotary screen 22 is positioned at an inclined position. For ease of discussion, the rotary screen 22 is best viewed as having a front section 38 and a rear section 40. Thus, in the illustrated preferred embodiment, the screen is inclined such that the rear section 40 is higher than the front section 38. The amount of incline is variable and is dependent upon a variety of factors, for example, material properties. However, an inclination of approximately 18% is considered optimal for most road materials.

As depicted more clearly in FIGS. 2 & 3, a feed chute 28 is disclosed. In a presently preferred embodiment, the feed chute 28 is located adjacent the rear section 40 and is positioned to direct material into the center of the rotary screen 22. The specific geometric configuration of the feed chute 28 is variable and is not to be considered a limiting feature. The width and angle of the feed chute 28 relative to vertical is a function of several variables, for example, the size of the rotary screen 22 employed, the nature of machine feeding the material into the feed chute 28 and the nature of the material encountered. Consequently, a feed chute 28 of any geometry is considered within the scope of this invention.

A waste transport structure 46 is positioned adjacent the front section 38. The waste transport structure 46 is configured to transport waste material a distance from the reclamation device 20, for example, back into a ditch along side the road or into a vehicle such as a truck (not shown). In a presently preferred embodiment and as illustrated in the FIGURES, the waste material transport structure 46 is a two element conveyer 42. However, a conveyer 42 having any number of conveyer elements is considered within the scope of this invention. Additionally, any other material transporting structure 46 is considered within the scope of this invention, for example, an auger (not shown). Further, the length, width and angle of the transport structure 46 relative to horizontal is variable and dependent upon the environment the device 20 is employed. Still further, in a preferred embodiment, a hydraulic drive motor (not shown) powers the transport structure 46. However, another other drive mechanism is considered within the scope of this invention, for example, electric or mechanical drive mechanisms.

In operation, the reclamation device 20 separates usable displaced road surface material from a variety of unwanted and unusable debris. This reclamation device 20 and process allows operators to bring a road back into a proper road profile. Material along the side of the road, or in the ditch, is brought up onto the road surface by a road grader or other such device (not shown). When the material is brought up onto the road, the material forms a continuous "windrow" of intermixed usable road material and unusable debris. A machine, for example the Athey belt loader, picks up the material and transfers the material to the feed chute 28. The feed chute 28 directs the material into the center of the cylindrical rotary screen 22. The rotational movement of the screen in combination with the material disruption caused by the agitation members 36 separates the reclaimed road material from the unusable debris. The reclaimed road material falls through the bottom of the screen and is deposited in another windrow on the road surface. The unusable debris is transported through the cylindrical screen 22 and onto the waste material transport structure to be deposited a distance from the road surface. As discussed above, the debris can be deposited into the ditch or into another machine to be hauled away.

While the preferred embodiment of the invention has been illustrated and described, as noted above, many changes can be made without departing from the spirit and scope of the invention. For example, the cylinder may be inclined so the front section of the cylinder is higher than the rear section. In this embodiment, the location of waste material transport structure and the feed chute would be reversed. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A road material reclamation device, comprising:

a propelling machine;

a moveable frame attached with the propelling machine, the moveable frame having a drive mechanism;

a generally cylindrical rotary screen attached with the drive mechanism and being inclinable and rotatable about an axis, the axis inclinable relative to the moveable frame, the rotary screen having an interior, a front section, a rear section situated higher to the front section, a side rolling surface located adjacent the front section and the rear section, each side rolling surface being configured to engage the drive mechanism, and a flange section adjacent the side rolling section;

a feed chute adjacent to the rear section and configured to deliver unseparated road material to the approximate center of the rotary screen interior;

a waste transfer structure adjacent to the front section and configured to receive road material from the rotary screen interior; and a cylindrical end frame supporting at least one cylindrical end roller, the end frame and at least one end roller being configured to engage the flange section, whereby road material is delivered to the rotary screen interior and rotating action of the rotary screen caused by the drive mechanism causes the separation of the road material mixtures into usable and unusable fractions such that the usable fraction is radially expelled through the mesh of the rotary screen back to the road from which the unseparated road material originated, and the unusable road material fraction is axially conveyed from the rotary screen interior to the waste material transfer device.

2. The device of claim 1, wherein the waste material transfer structure delivers the unusable road material to a plurality of locations, including a waste transfer vehicle and to the side of the road.

3. The device of claim 1, wherein the useable road material is delivered in a substantially center row in direction with the movement of the frame.

4. The device of claim 1, wherein the rotary screen includes a plurality of agitation members including members axially disposed along the inner surface of the screen and spiral members disposed along the inner surface of the screen, each member configured to increase the structural rigidity of the screen and increase road material separation.

5. The device of claim 1, wherein the rotary screen is configured to have variable mesh sizes, variable mesh shapes, and inclination angles to accommodate the material properties of road material delivered to the rotary interior and the desired material properties of the useable road material expelled through the rotary screen mesh.

6. The device of claim 5, wherein the mesh screen opening is large to deliver usable road material suitable for drainage.

7. The device of claim 5, wherein the mesh screen opening is small to deliver usable road material suitable for dense packing.

8. The device of claim 1, wherein the angle of the rotary screen is approximately at an 18% incline.

9. A road material reclamation device, comprising:

a propelling machine;

a moveable frame attached with the propelling machine, the moveable frame having a drive mechanism;

a generally cylindrical rotary screen attached with the drive mechanism and being inclinable and rotatable about an axis, the axis inclinable relative to the moveable frame, the rotary screen having an interior, the interior having at least one agitation member axially disposed along the inner surface of the rotary screen, a front section, a rear section configured higher to the front section, a side rolling surface located adjacent the front section and the rear section, each side rolling surface being configured to engage the drive mechanism, and a flange section adjacent the side rolling section;

a feed chute adjacent to the rear section and configured to deliver unseparated road material to the approximate center of the rotary screen interior;

a waste transfer structure adjacent to the front section and configured to receive road material from the rotary screen interior; and a cylindrical end frame supporting at least one cylindrical end roller, the end frame and at least one end roller being configured to engage the flange section, whereby road material is delivered to the rotary screen interior and rotating action of the rotary screen caused by the drive mechanism causes the agitator member to suspend and break apart the road material and causes the rotary screen to separate the broken road material into usable and unusable fractions such that the usable fraction is radially expelled through the mesh of the rotary screen back to the road from which the unseparated road material originated and the unusable fraction is axially conveyed from the rotary screen interior to the waste material transfer device.

10. The device of claim 9, wherein the at least one agitator member includes members axially disposed along the inner surface of the screen and spiral members disposed along the inner surface of the screen, each member configured to increase the structural rigidity of the screen and increase road material separation.

11. The device of claim 9, wherein the rotary screen is configured to have variable mesh sizes, variable mesh shapes, and inclination angles to accommodate the material properties of road material delivered to the rotary interior and the desired material properties of the useable road material expelled through the rotary screen mesh.

12. The device of claim 11, wherein the mesh screen opening is large to deliver usable road material suitable for drainage.

13. The device of claim 11, wherein the mesh screen opening is small to deliver usable road material suitable for dense packing.

* * * * *